US005409295A

United States Patent [19]

Edstrom

[11] Patent Number: 5,409,295

[45] Date of Patent: Apr. 25, 1995

[54] OMNIDIRECTIONAL TILTING MECHANISM

[75] Inventor: Andrew Edstrom, N. Pahoa, Hi.

[73] Assignee: Omniflex Specialties, Palo Alto, Calif.

[21] Appl. No.: 67,345

[22] Filed: May 25, 1993

[51] Int. Cl.[6] ..... A47C 3/026

[52] U.S. Cl. ..... 297/314; 297/258; 297/303; 297/326; 297/304; 248/372.1

[58] Field of Search ..... 297/258, 264, 302, 303, 297/304, 313, 314, 326; 248/372.1, 603, 604

[56] References Cited

U.S. PATENT DOCUMENTS

| | | | |
|---|---|---|---|
| 1,429,979 | 9/1922 | Spanenberg | 297/314 X |
| 1,678,668 | 7/1928 | Collier . | |
| 1,723,415 | 8/1929 | Ferris . | |
| 2,048,148 | 7/1936 | Stoll . | |
| 2,862,710 | 12/1958 | Lewis | 297/302 X |
| 3,669,399 | 6/1972 | Wager | 248/373 |
| 4,099,697 | 7/1978 | Von Schuckmann | 248/385 |
| 4,185,803 | 1/1980 | Kalvatn | 248/608 |
| 4,236,752 | 12/1980 | Mizelle | 297/303 |
| 4,371,142 | 2/1983 | Bottemiller et al. | 248/573 |
| 4,425,863 | 1/1984 | Cutler | 114/363 |
| 4,431,157 | 2/1984 | Arild | 248/583 |
| 4,498,656 | 2/1985 | Arild | 248/608 |
| 4,575,151 | 3/1986 | Edstrom | 297/304 |
| 4,736,984 | 4/1988 | Tacker | 297/264 |
| 4,807,841 | 2/1989 | Edstrom | 248/580 |
| 5,039,164 | 8/1991 | Gibbs | 297/302 |
| 5,106,157 | 4/1992 | Nagelkirk et al. | 297/304 |

FOREIGN PATENT DOCUMENTS

| | | | |
|---|---|---|---|
| 515835 | 8/1955 | Canada | 297/314 |
| 2159869 | 6/1973 | Germany . | |

*Primary Examiner*—Peter R. Brown

[57] ABSTRACT

An omnidirectional tilting mechanism comprising a low profile package interposable between a support and a tiltable member. The mechanism includes a first element secured to the support and a second element secured to the tiltable member. The first and second elements move relative to one another in an omnidirectional manner about a pivot element centrally disposed relative to the first and second elements. The resistence to tilting is controlled by flexural elements interconnecting the first and second elements which act to return the first and second elements to a neutral, home position.

22 Claims, 7 Drawing Sheets

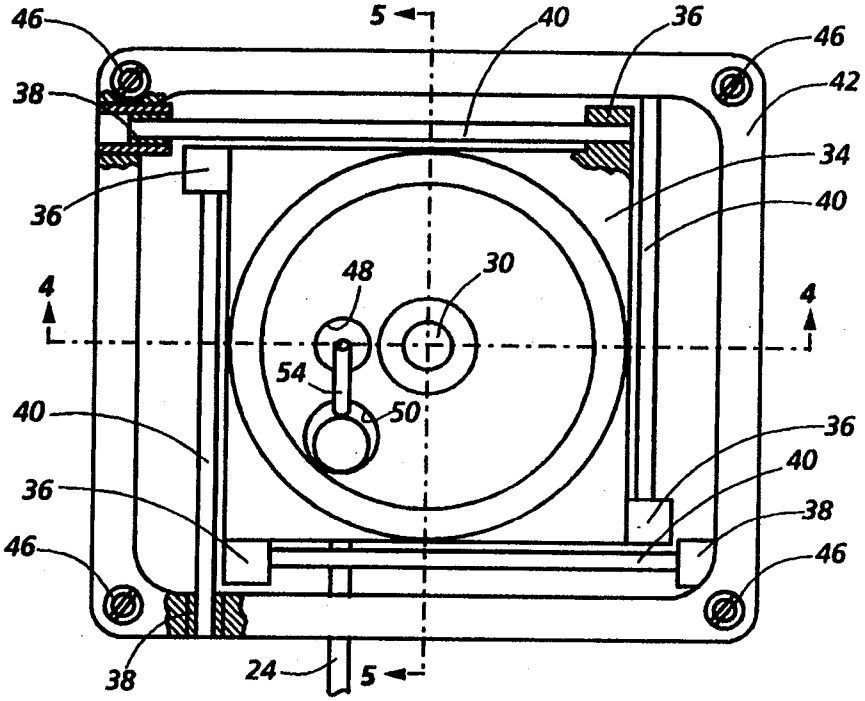
Fig. 3
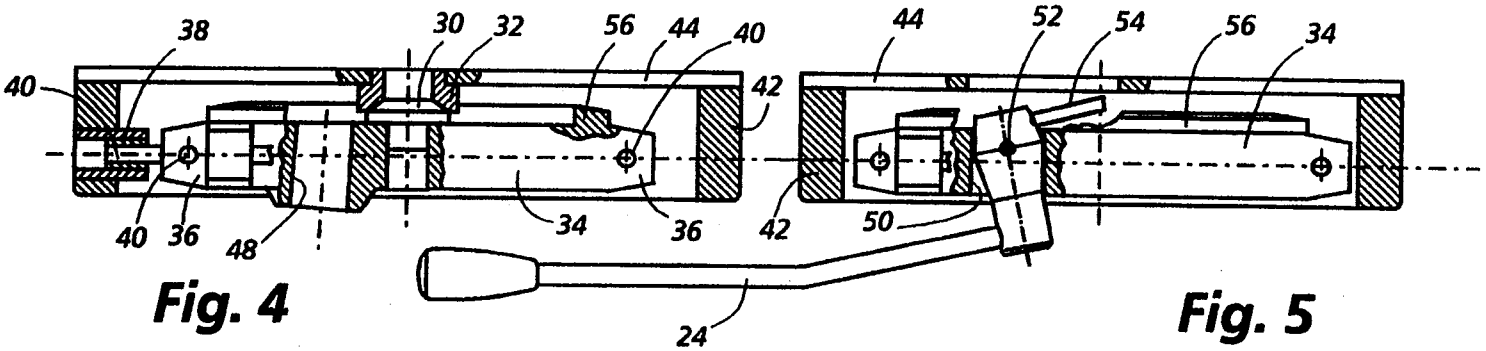
Fig. 4
Fig. 5

OMNIDIRECTIONAL TILTING MECHANISM

FIELD OF THE INVENTION

The present invention relates to the control of movement between a pair of structures tiltable relative to one another, such as a chair seat and its support and, more particularly, to an inexpensive and compact mechanism interposable between the structures. When applied to a chair seat and its support, it allows the chair seat to be tilted in all directions relative to its support in a controlled manner.

BACKGROUND OF THE INVENTION

Tilting mechanisms for the seat of a chair are well known. Typically, such mechanisms allow only rearward tilting and employ an adjustable spring-like mechanism to return the seat to a generally horizontal position when the chair is not in use. Chairs such as these are in common use and have the advantage, over rigid chairs, that the occupant may shift his position in order to transfer the pressure of sitting from one part of his anatomy to another. This shifting is found to be relaxing and aids in postponing or even preventing tension and fatigue.

Improvements over rearward tilting are to be found in U.S. Pat. No. 1,678,668 (Collier) wherein there is disclosed a chair tilting mechanism which tilts forwardly as well as rearwardly and in U.S. Pat. No. 1,723,415 (Ferris) wherein there is disclosed a chair tilting mechanism which is capable of a limited lateral rocking or tilting movement.

Further improvements allowing omnidirectional tilting of chair mechanisms are described in U.S. Pat. Nos. 2,048,148 (Stoll), 4,099,697 (Von Schuckmann), 4,185,803 (Kalvatn), 4,431,157 (Arild) and 4,498,656 (Arild).

The Stoll patent discloses a ball joint surrounded by a coil spring held in compression between a flange and a seat mounted swivel bearing. A stub shaft extends between the ball and the swivel bearing, so that as the occupant's weight is shifted on the seat, tilting can occur in any direction. As soon as the lateral thrust force is relieved, the seat will return to its neutral, home position. This mechanism may be interposed between a standard pedestal tube and the chair seat.

In the Von Schuckmann patent the omnidirectionally tilting mechanism must be located in a uniquely constructed base support structure. It comprises a ball received in a socket :for universal movement with a shaft secured to and extending from the ball. A star-like array of generally radial tension springs is attached to the shaft and yieldably resist deflection of the shaft out of its normal position in all directions.

The patented Kalvatn mechanism comprises a pair of concentric rings which are mutually moveable, each about a torsion bar. Its universal tilting mechanism may also be mounted between standard chair seats and pedestals.

Similarly, in each of the Arild patents there is disclosed a tilting mechanism comprising a pair of torsion bar elements mounted upon yokes disposed normally to one another. These mechanisms also may be mounted between standard chair seats and pedestals.

Although, as noted, it is possible to interpose several types of the known omnidirectionally tiltable chair support structures between standard seats and seat supports, they are all of a size and complexity which require extensive modifications to existing chair structures for their incorporation therein. Thus, their interposition is not only impractical but the appearance they present is unsightly.

In a related patent, U.S. Pat. No. 4,807,841, "Omnidirectionally Tilting and Swivelling Support Mechanism for Chairs or the Like" (Edstrom) herein fully incorporated by reference, I have disclosed a structure which relies upon flexurally distorting a control shaft. The dimensions of the mechanism allow it to be mounted totally out of sight, completely within a standard tubular chair support pedestal.

It is an object of the present invention to provide an improved omnidirectional tilting mechanism, utilizing flexure members, interposable between a support structure and a supported structure, which allows self righting, relative tilting movement between these structures over a full 360 degrees and has a low profile, allowing it to be mounted unobtrusively between these structures. When incorporated into a chair, it may be disposed upon any standard pedestal shaft (including those incorporating a gas powered lift therein), or ether type of seat support for supporting any standard seat, without detracting from the functionality of either the support or the seat.

SUMMARY OF THE INVENTION

These and other objects may be carried out, in one form, by providing an omnidirectionally tilting mechanism interposable between a support and a tiltable member for allowing the tiltable member to be omnidirectionally tiltable relative to the support. In particular, the support may be a chair seat support and the tiltable member may be a chair seat. The mechanism comprises a first element securable to the support and being static when so secured. A second element is securable to the tiltable member and is dynamic when so secured. The second element is tiltable in all directions, relative to the first element, about a pivot joint having portions positioned on both the first and second elements. Flexure members interconnect the first and second elements and control the tilting movement as they are strained solely in a flexural mode by a tilting force. Flexural strain provides resistance to the tilting force and returns the second element to a neutral, home position when the tilting force is removed.

BRIEF DESCRIPTION OF THE DRAWINGS

Other objects and further features and advantages of my invention will be apparent from the following, more particular, description considered together with the accompanying drawings, wherein:

FIG. 3 is a plan view of the present configuration of the working model of the tilting mechanism of my invention looking down from the chair seat, with the thrust load bearing base plate having been removed;

FIG. 4 is a sectional view taken substantially along line 4—4 of FIG. 3, but showing the base plate in place;

FIG. 5 is a sectional view taken substantially along line 5—5 of FIG. 3, also showing the base plate in place;

DETAILED DESCRIPTION OF THE ILLUSTRATED EMBODIMENTS

Figure 1A:
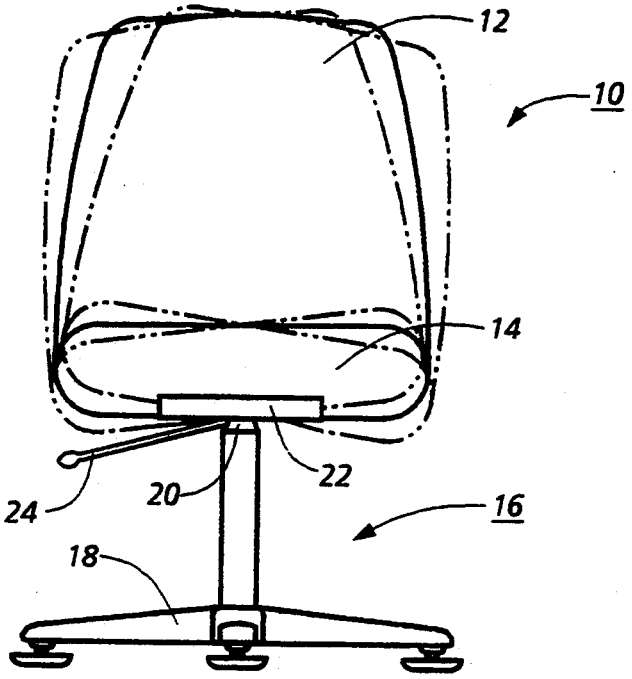
FIGS. 1A and 1B are schematic front and side elevation views of a chair incorporating the omnidirectional tilting mechanism according to my invention.
Figure 1B:
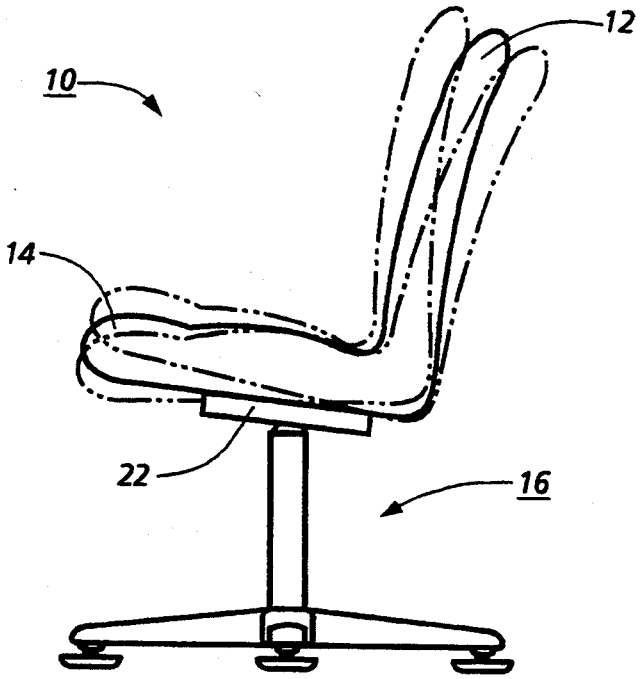

Referring to FIGS. 1A and 1B, my invention is shown as applied to a chair 10 having a back 12, a seat 14, a pedestal 16 and a leg assembly 18. The configurations of the seat and back are matters of design choice and a wide variety of designs can be employed. A support shaft 20 extending outwardly from the upper end of the pedestal 16 is rigidly connected to the omnidirectional tilting mechanism 22 which, in turn, is mounted to the bottom of seal 14 by means of a screws or other suitable fasteners (not shown). The tilting mechanism 22 of my invention may be interposed between any standard pedestal (including gas or fluid lifting types) and any standard seat. It allows an occupant, sitting on the seat, to selectively tilt forward and backward, as indicated by the phantom lines in FIG. 1B, side-to-side, as indicated by the phantom lines in FIG. 1A, and in all directions therebetween, i.e., omnidirectionally, a full 360 degrees. The tilting mechanism in no way impairs swivelling of the seat a full 360 degrees, as that function, if desired, would be incorporated in the pedestal design.

As will be described below, the omnidirectional tilting mechanism is based upon the principle of flexure of a plurality of coplanar control beams which are stressed when a tilting force is applied to the seat. In their neutral state, the beams lie in a plane substantially parallel to the plane of the bottom of the seat. The beams will be strained solely in a flexural mode by fixing only one end of each of the control beams to an anchoring member and allowing the opposite end of each beam to be loosely constrained within a positioning bushing, so as to be free to move rotationally and axially. By relying on flexural straining alone, the tilting mechanism 22 is able to take the form of a compact and unobtrusive package which may be placed directly between virtually any seat 14 and any pedestal 16. Provision may be made within the tilting mechanism to access the standard height adjusting control valve on the top of the pedestal by means of a standard lever 24.

Figure 2A:
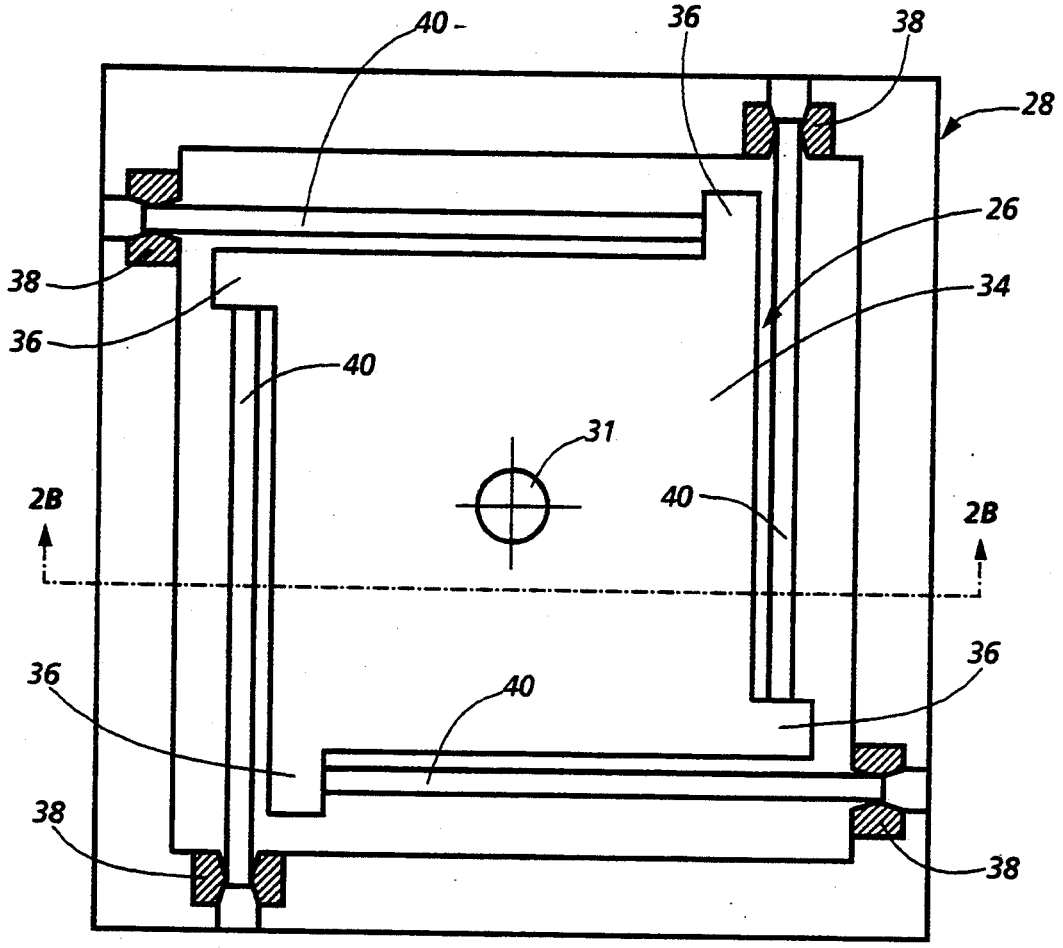
FIG. 2A is a partial schematic plan view of the preferred form of the omnidirectional tilting mechanism of the present invention.
Figure 2B:
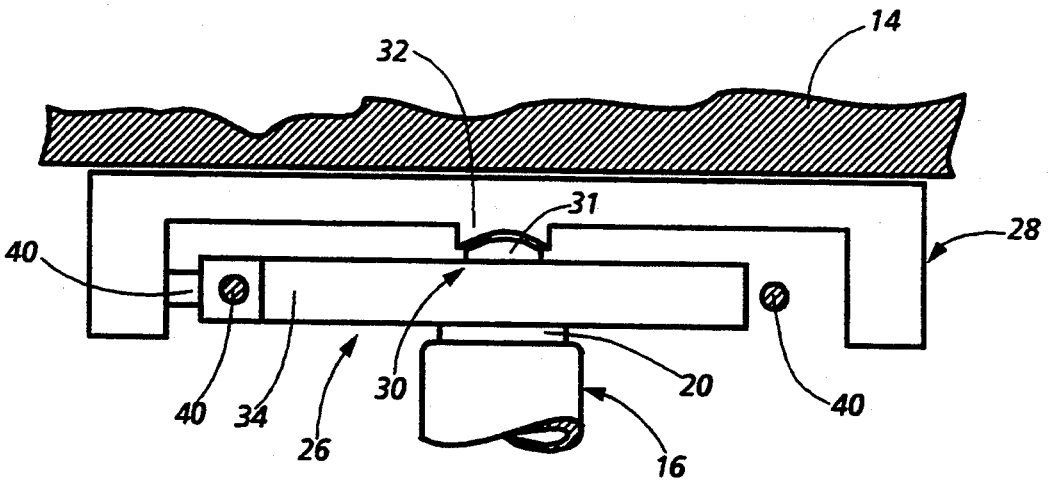
FIG. 2B is a schematic sectional view, taken substantially along line 2B—2B of the preferred form of the omnidirectional tilting mechanism of the present invention.

A schematic representation of the preferred form of the tilting mechanism of this invention is shown in FIGS. 2A and 2B. It comprises a static member 26 which is secured to the pedestal 16 and a dynamic member 28 which is secured to the seat 14. Relative movement between these two members takes place about a pivot joint 30 which may comprise a ball member 31 cooperating with a concave socket member 32. Alternatively, the pivot joint may take the form of a one piece elastomer having one portion anchored to the static member and another portion anchored to the dynamic member. As illustrated, the static member 26 is a central anchor 34, which may be in the form of a rigid plate having bosses 36 extending outwardly from its corners and securely mounted upon the support shaft 20 of pedestal 16. The dynamic member 28 is a circumferential frame which surrounds the anchor and has bushings 38 therein in axial alignment with the bosses 36. It is secured to the seat 14. Coplanar flexure beams 40, of equal length, each have one end fixed within a boss 36 and an opposite end free to rotate and to move axially within a bushing 38. The axis of each flexure beam is equidistant from the central pivot joint 30. I have found that flexure members made of chrome/silicon spring steel are suitable to the extended flexure life intended for a device of this type.

As the occupant of the chair shifts his weight, the seat and the dynamic member 28 tilt about the pivot joint 30, moving the bushings 38 to flex the beams 40. Thus, as the occupant of the chair moves the seat, the dynamic member 28 attached thereto will move relative to the static member 26 in a controlled omnidirectional tilting manner. Some flexure beams are driven downwardly while others are driven upwardly because one portion of the dynamic member will move downwardly relative to the static member, while its opposite portion will move upwardly. Torsion forces and axial tension and compression forces on the flexure beams are prevented since one end of each flexure beam is fixed and the opposite end, while being positioned, is unconstrained, i.e., free to rotate and slide within the bushings. Since only flexural forces strain the flexure beams, beam stress is significantly reduced, allowing an increased dynamic range of the tilting action, and resulting in an increase in beam lifetime.

I contemplate numerous changes in the relationships of these members. For example, it is well within the purview of my invention to reverse the functions and relative locations of the anchoring member and the circumferential frame, whereby the anchoring member is dynamic and is attached to the seat, while the frame is static and is mounted on the pedestal. It is possible to mount the beams so that their fixed ends are secured in the circumferential frame and their rotatable/slidable ends are in the anchoring member. It is also possible to mount less than all of the beams with one end fixed in either the static or dynamic member and the remainder of the beams with their fixed ends fixed in the other member, In such a case, the opposite ends of the beams would be free to slide and rotate in the opposite member. It is also possible to substitute a bundle of multiple flexure beams for each of the single flexure beams shown, as long as the same mounting principle is observed, i.e., one of the ends of the beam bundles is fixed in one member while the opposite ends of the beam bundles are free to slide and to rotate within bushings in the other member. Another possible change could be to form the flexure beams with a non-circular cross-section, such as square, or any other shape dictated by the stress load, the desired resistance characteristics, or beam lifetime. Furthermore, the present mechanism may be used with any type of seat support member, such as a four-legged type, not merely the standard pedestal as shown. In fact, my invention may be interposed between any two structures when an omnidirectional tilting movement is desired therebetween.

More specific details of one possible configuration of the tilting mechanism are illustrated in FIGS. 3 to 5. Dynamic member 28 is in the form of a circumferential rectangular frame 42 to which a base plate 44 is secured. Mounting holes 46 passing through the frame and the base plate allow fasteners, such as screws, to secure the dynamic member to the seat. Depending upon the chair design and its preexisting mounting holes, the mounting holes of the dynamic member may be located inwardly of the frame, solely through the base plate. A socket member 32 of the pivot joint 30 is positioned at the center of the base plate. The frame supports the bushings 38, each of which, in its preferred form, has a dual conical internal bore so as to provide solely a line of contact with a flexure beam passing therethrough for allowing the beam to slide and rotate freely therein.

A more complex, but equally durable construction, would be a ball, or ball-like, joint having a cylindrical bore therethrough, secured within the frame. The ball would be free to rotate within the frame and the flexure beam would be able to slide within the cylindrical bore. It is also possible to press fit the flexure beam into a first bushing which, in turn, slides and rotates within a second bushing secured in the frame. By encapsulating the beam end in a relatively compliant elastomer, rather than the rigid plastic bushing material, its freedom to slide and to rotate within the frame would be effected by the flexible elastomer. An extension of this type of construction would be to coat the entire corrosion-prone beam in a protective sleeve so as to protect it from corrosive atmospheres, as would be encountered in a nautical environment. In another modified form of this invention, the frame 42 could be eliminated and a plurality of posts could project from the base plate 44 to support the bushings 38.

The static anchoring member 34 has a tapered hole 48 for receiving the standard tapered end of support shaft 20. To accomodate an adjustable height, gas lift type pedestal 16 a second hole 50 is provided to receive lever assembly 24 which controls the standard chair lift actuator button (not shown) on the top of the pedestal. A pivot pin 52, passing through the lever assembly and secured in the anchoring member provides the pivot axis about which leverage is applied to the actuator button, via trigger 54. The secured ends of flexure beams 40 are preferably press fit into sockets in bosses 36 of the anchoring member.

As described above, relative movement between the central anchoring member and the circumferential frame 42 is enabled by the pivot joint 30, whose ball member 31 is positioned at the center of the anchoring member, so as to be located at the geometric center of the flexure beam array. The weight of the seat and its occupant is transmitted through the pivot joint to the chair support. The flexure beams are only subjected to flexure loads resulting from the tilting of the ring frame 42 about the pivot joint. The ball member 31 and the socket member 32 may be made of any materials that have very good wear life when moved relative to one another. Preferably, these parts should be made of compatible moldable plastic materials, such as Delrin and UHMW (ultra-high molecular weight) polyethylene, and the like.

A stop ring 56 limits relative movement between the frame and the anchoring member for preventing excessive bending of the flexure beams and for providing a comfortable "feel" to the occupant. Although the stop ring is shown mounted on the anchoring member 34, it is also possible to mount it on the base plate 44. As shown, it is integral with member 34 by being cast or machined therein. In another embodiment, the stop ring may be in the form of a molded elastomeric material assembled to the anchoring member, so as to enable a silent, soft stop. This stop ring may be tailored to limit the angle of tilt to the desired range which I have found to be about 5 to 10 degrees off center in all directions.

Figure 6:
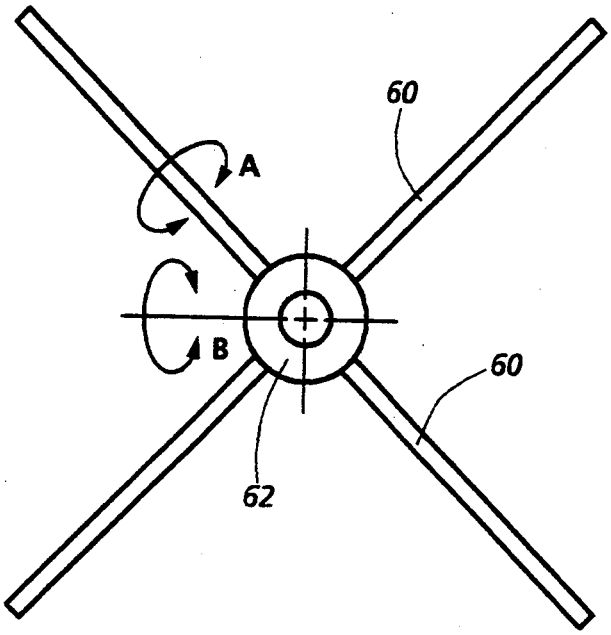
FIG. 6 is a schematic view of a radial form of the omnidirectional tilting mechanism of the present invention.

I have illustrated in FIGS. 6 through 9 several alternative embodiments of my invention having different configurations of the anchoring member and different numbers and orientations of the flexure beams. In FIG. 6, flexure beams 60 are secured in and extend radially outwardly from a common central anchoring member 62 which also supports one member of the pivot joint. Although four beams are shown, three or more angularly equidistant beams will work. I have found that this construction, while it will work, may be impractical for several reasons. First, in order to work with beams of a practical diameter (less than one half inch), the beams would be probably too long to fit within a conveniently small package which could be inconspicuously placed beneath a standard seat. Second, radiating beams produce an unequal beam stress pattern. Because the axes of the beams pass through the central pivot joint, there will be instances (as indicated by arrow A) when the tilt axis will be aligned with one of the beam axes and that beam will not flex but will merely rotate within its respective bushings. Since the other beams will flex, a non-uniform flexure pattern will be established. In fact, the only time that the stress will be equalized among the several beams is when the tilt axis bisects the angle between the beam axes (as indicated by arrow B). The principle in evidence herein is that it is highly desirable that the beam configuration be such that all of the beams flex equally each time tilting occurs. To obtain such a result, the stress pattern should be simultaneously uniform in each of the flexure beams while providing the righting force to return the seat and occupant to the central, neutral position. There are instances, however, when it might be desirable to provide an omnidirectional tilting mechanism whose resistance to tilting fore and aft is different from its resistance to tilting side to side. I believe that the resistance to left side and right side tilting should be substantially equal in order to provide the occupant with a sense of stability but that the resistance to forward and backward tilting may be tailored to achieve differences which may prove to be desirable.

Figure 7:
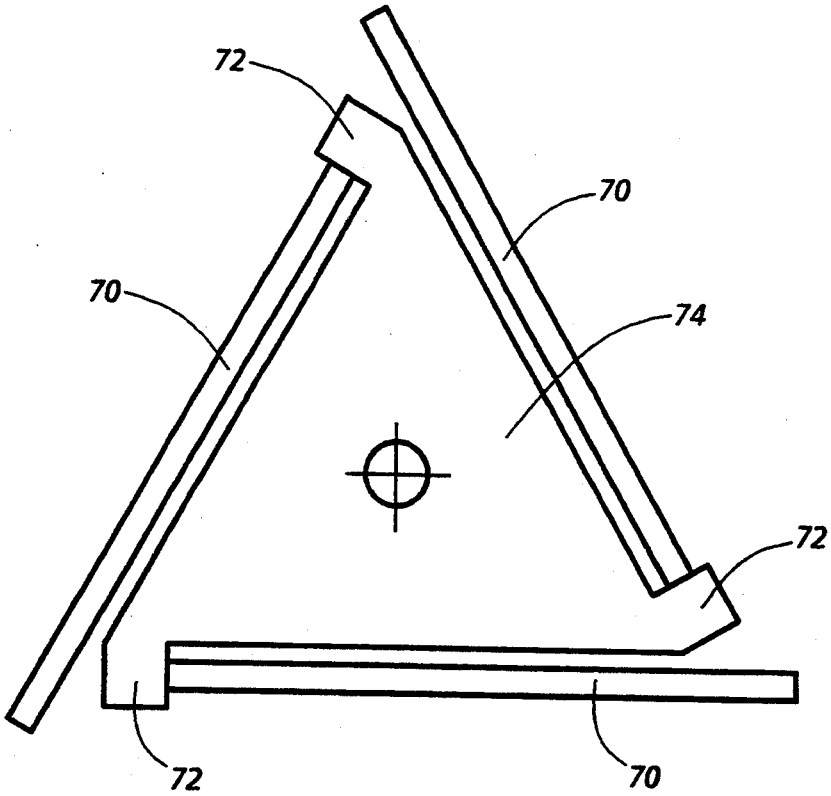
FIGS. 7 and 8 are two further schematic views showing other possible forms of the omnidirectional tilting mechanism of the present invention.
Figure 8:
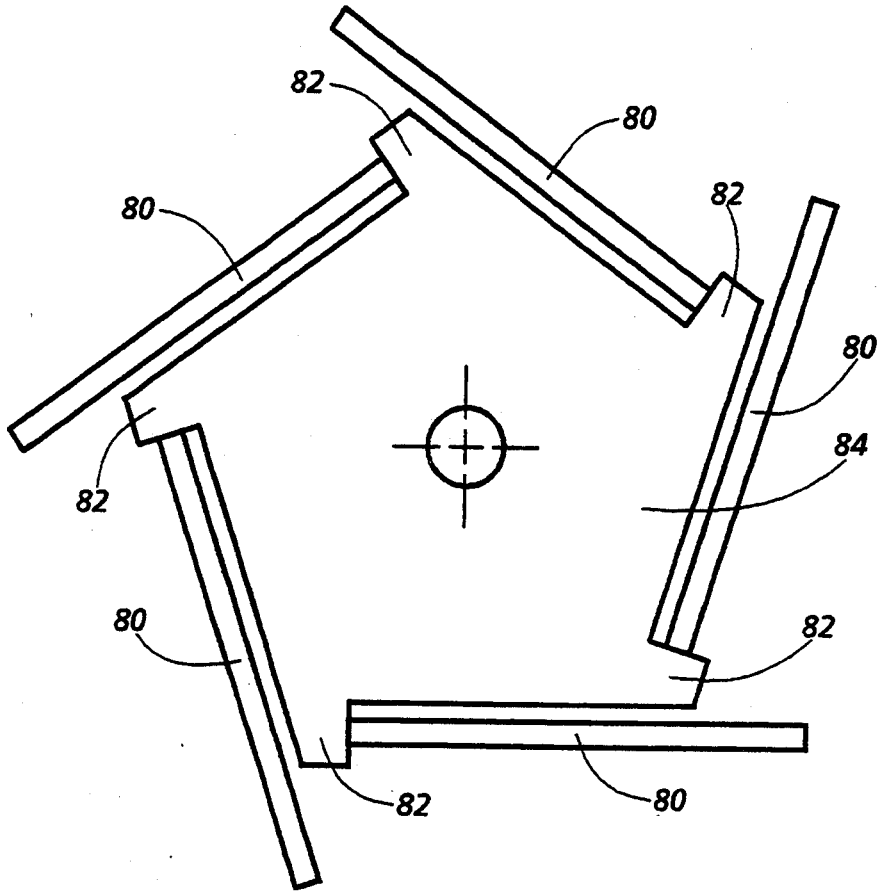

In FIG. 7 only three flexure beams 70 are anchored in bosses 72 of anchoring member 74. While in FIG. 8 five flexure beams 80 are anchored in bosses 82 of anchoring member 84. It should be understood that a complementary frame member is needed to complete these omnidirectional tilting mechanisms. Clearly, my invention contemplates a great many different configurations with different numbers of beams. Not all of these will be practical, as they may dictate packages and mounting arrangements which may be too large or too expensive for a desired application. However, they may be appropriate for other applications.

Figure 9:
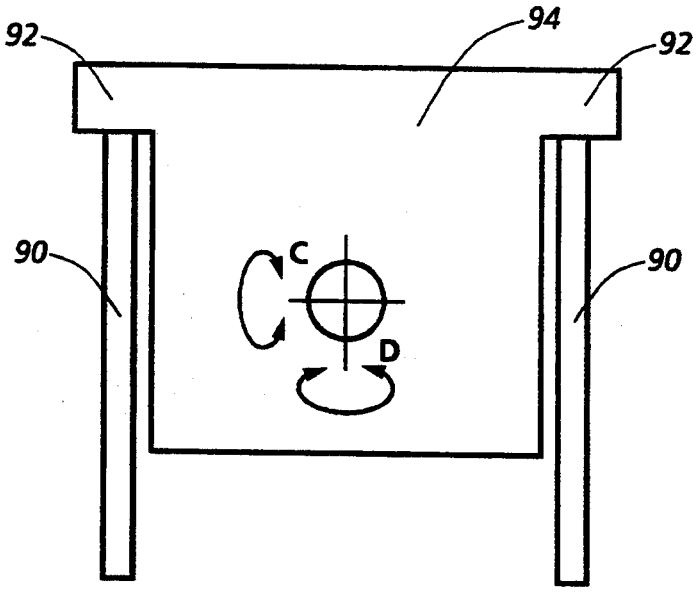
FIG. 9 is yet another schematic view of an alternative form of the omnidirectional tilting mechanism of the present invention.

At a minimum, my invention contemplates two flexure beams whose axes of flexure are equidistant from the pivot point of the tilting system. However, it should be noted that in the FIG. 6 embodiment, the beam axes pass through the pivot joint and are not offset therefrom. In FIG. 9 there is shown two flexure beams 90 secured in bosses 92 of anchoring member 94. When tilting takes place in the direction parallel to the beams (as indicated by arrow C), both beams will flex in that direction. However, when tilting takes place in the direction transverse to the beams (as indicated by arrow D), they will flex oppositely to one another since one boss 92 drives the fixed end of one of the beams downwardly, while the other boss 92 drives the fixed end of its beam upwardly.

I have described, in FIGS. 2 through 5, the preferred embodiment of my invention as including four flexure beams interposed between a static member and a dynamic member, with a single flexure beam at each beam location. The "feel", or desired resistance to tilting, which I have settled on is achieved when each beam is about 0.3125 inch in diameter and has a free length of approximately 6.5 inches.

Figure 10:
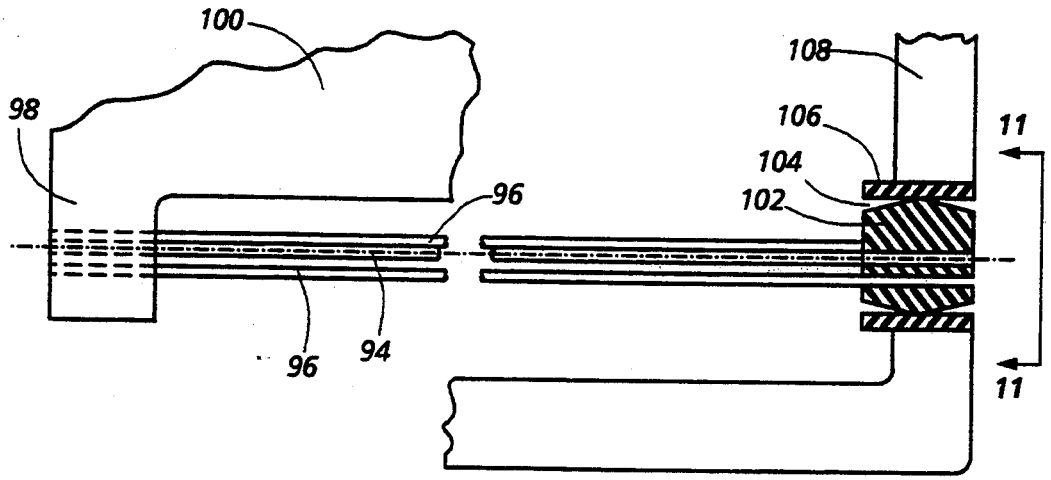
FIG. 10 is a partial schematic view of a mounting arrangement provided to accommodate a bundle of smaller diameter flexure rods at each flexure beam location.
Figure 11:
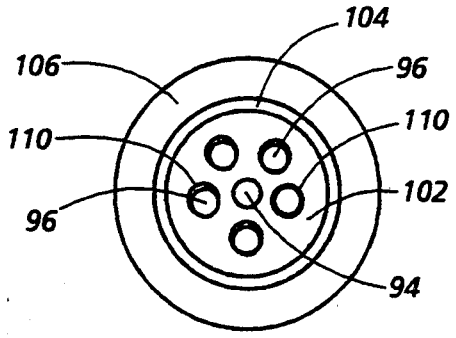
FIG. 11 is a view taken substantially in the direction of line 11—11 of FIG. 10.

My experimentation has indicated that it is possible to retain the same "feel" while substantially increasing the lifetime of this tilting mechanism, by substituting a bundle of smaller diameter rods for each single flexure beam. A configuration which I have found to be quite satisfactory comprises a bundle of six rods, each about 0.2 inches in diameter and about 6.5 inches long, wherein a central rod 94 is surrounded by five equally spaced rods 96. In FIGS. 10 and 11 there is shown the preferred mounting arrangement for such a bundle of rods. The fixed ends of the central rod 94 and surrounding rods 96 are press fit into boss 98 extending from static anchoring member 100. The slidable/rotatable ends of the rods 94 and 96 are confined in bushing 102 which is provided with a convex outer diameter 104 enabling it to freely rotate and slide within a journal 106 secured in the frame 108. As illustrated in FIG. 11, the central rod 94 is tightly fit in a central opening in the bushing 102 thus allowing the bushing to be held laterally in place relative to the bundle of rods and the journal 106. The surrounding rods 96 loosely pass through openings 110 in the bushing 98 so that they may slide relative thereto. Although the "free" end of the central rod 94 is fixed in the bushing, its central location allows it to be a neutral fiber which will only undergo flexure strain. This arrangement is comparable to those described above, in that the flexure member (i.e. rods plus bushing) has one end fixed and an opposite end free to slide and to rotate.

Figure 12:
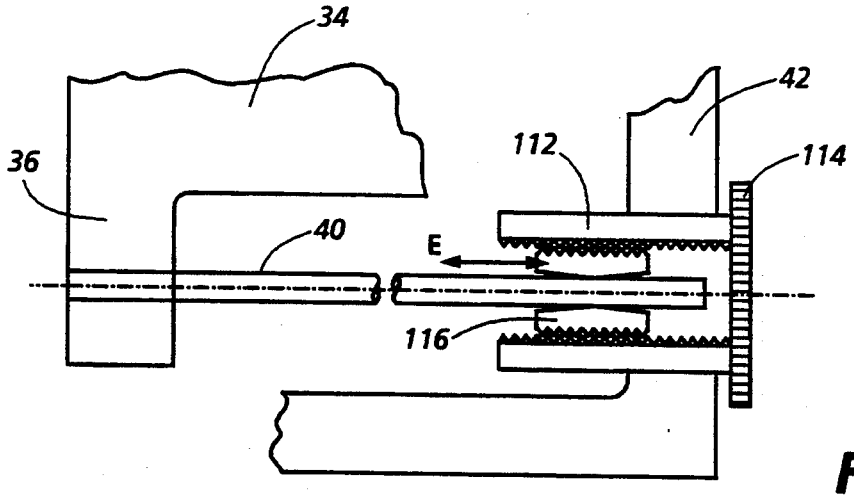
FIG. 12 is a schematic illustration of a flexure beam mounting arrangement provided to allow adjustable resistance in the tilting of the chair seat.
Figure 13:
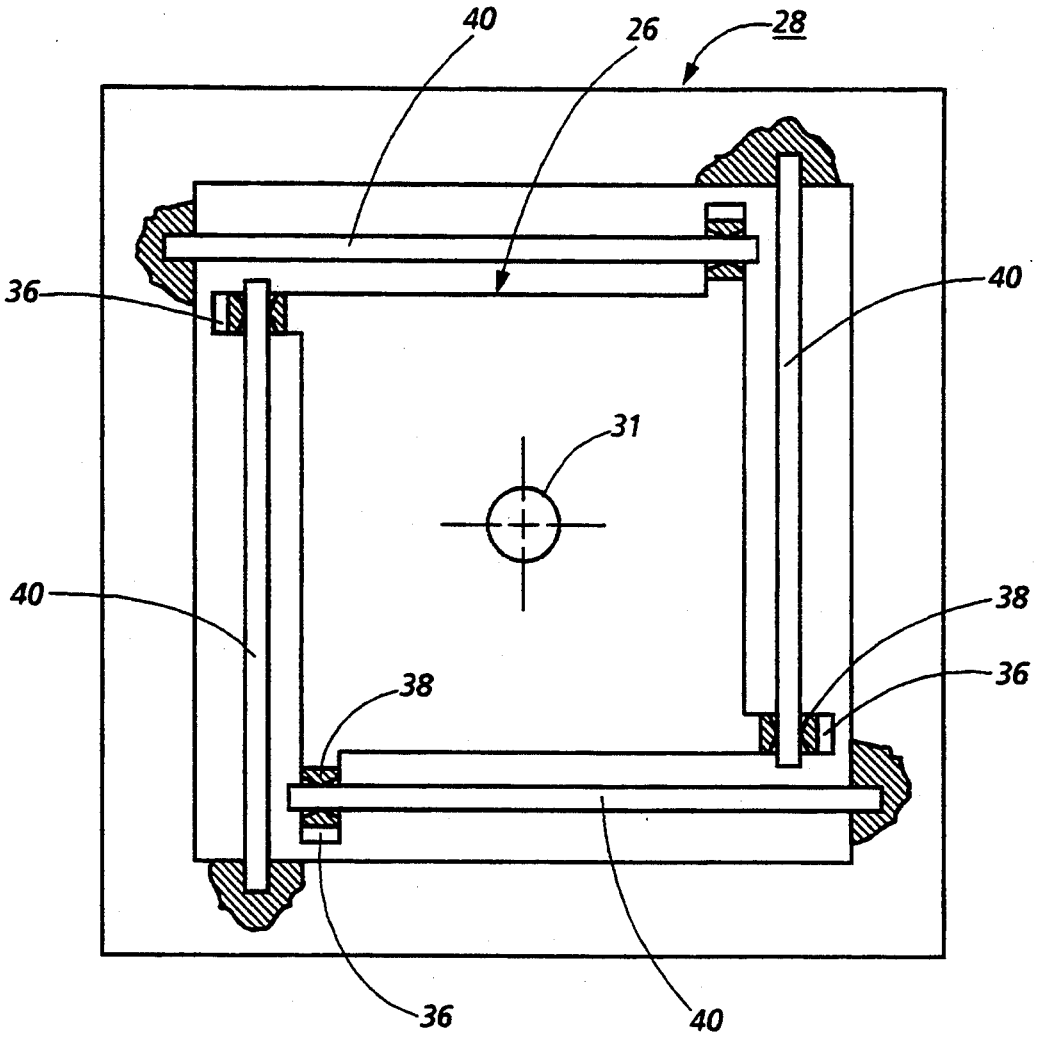

A further modification, as illustrated in FIG. 12, allows the occupant of the chair to adjust the "feel" of the device to his liking by changing the free length of the rods, thereby altering their spring rate and making the tilting action somewhat stiffer or looser. As the free length is decreased, the resistance to flexure is greater, and conversely, when the free length is increased, the resistance to flexure is reduced. A schematic illustration of an embodiment capable of effecting such an adjustment could include, at the slidable end of each rod 40, an internally threaded sleeve 112, having an adjustment knob 114. A double conical bushing 116 which loosely constrains the flexing/sliding end of each rod, is externally threaded. As the sleeve is rotated to indexed positions, it moves the bushing either inwardly or outwardly in the direction of the arrow E. It is possible to connect the adjustment knobs by suitable belting or gearing so that the movement of one of them, or movement of a control member, moves them all by the same amount.

It should be understood that the present disclosure has been made only by way of example, and that numerous other changes in details of construction and the combination and arrangement of parts may be resorted to without departing from the true spirit and the scope of the invention as hereinafter claimed.

What is claimed is:

1. Apparatus positionable between a seat and a seat support for allowing the seat to be omnidirectionally tiltable relative to the seat support, so that the seat may tilt forward and backward, side-to-side and all angles therebetween, comprising a first member securable to the seat support, a second member securable to the seat, a pivot joint located between, and in contact with said first and second members about which said second member is tiltably movable relative to said first member, and at least two elongated resistance elements located radially outwardly of said pivot joint, each resistance element fixedly connected at one end to one of said first or second members and movably connected at its opposite end to the other of said first or second members, so that said opposite end may rotate and move axially relative to said other of said first or second members, whereby upon application of a force tending to move said second member about said pivot joint, said resistance elements will be deformed to a strained state solely in a flexural mode, and upon removal of the force, said flexure members will return to an unstrained state and will return said second member to a neutral, home position.

2. The apparatus as defined in claim 1 wherein said resistance elements are coplanar.

3. The apparatus as defined in claim 1 wherein said resistance elements are equidistant from said pivot joint.

4. The apparatus as defined in claim 1 wherein said second member includes bushings therein and said resistance elements comprise rods having said one ends fixed in said first member and having said opposite ends free to rotate and to slide axially within said bushings.

5. The apparatus as defined in claim 1 wherein said first member includes bushings therein and said resistance elements comprise rods having said one ends fixed in said second member and having said opposite ends free to rotate and to slide axially within said bushings.

6. The apparatus as defined in claim 1 wherein each of said resistance elements comprises a single rod.

7. The apparatus as defined in claim 1 wherein each of said resistance elements comprises a plurality of rods.

8. The apparatus as defined in claim 1 further comprising means for adjusting the resistance to the force which tends to tilt said second member about said pivot joint.

9. The apparatus as defined in claim 8 wherein said means for adjusting comprises means for changing the free length of said resistance elements.

10. The apparatus as defined in claim 1 wherein said pivot joint is centrally located relative to said first and second members.

11. The apparatus as defined in claim 1 wherein a stop member is disposed between said first and second members for limiting the angle of tilt therebetween.

12. An omnidirectional tilting mechanism interposable between a support and a tiltable member, so that the tiltable member may tilt forward and backward, side-to-side and all angles therebetween, said mechanism comprising, a first member secured to said support, a second member secured to said tiltable member, a pivot centrally disposed relative to, and in contact, with said first and second members for allowing said second member to tilt omnidirectionally thereabout relative to said first member, and resilient members interconnecting said first and second members located radially outwardly of said pivot joint, each resilient member fixedly connected at one end to one of said first or second members and movably connected at its opposite end to the other of said first or second members, in order to allow said opposite end to rotate and to move axially relative to said other of said first or second members, thereby controlling the resistance to tilting between said first and second members.

13. The tilting mechanism as defined in claim 12 wherein said second member includes bushings therein and said resilient members comprise at least two flexure members, each of which has one end fixed in said first member and its opposite end free to slide and rotate in said bushings.

14. The tilting mechanism as defined in claim 12 wherein said first member includes bushings therein and said resilient members comprise at least two flexure members, each of which has one end fixed in said second member and its opposite end free to slide and rotate in said bushings.

15. The tilting mechanism as defined in claim 12 wherein said resilient members comprise spring rods which are strained solely in a flexural mode as said first and second members are tilted relative to one another.

16. The tilting mechanism as defined in claim 15 further comprising an adjustment device located between said opposite ends of said spring rods and said other of said first or second members, for changing the free length of said spring rods, between said one ends and said opposite ends, and thereby altering the resistance to tilting between said first and second members.

17. The apparatus as defined in claim 16 wherein said adjustment device encircles said opposite ends of each of said spring rods and is axially movable relative to each of said spring rods.

18. The tilting mechanism as defined in claim 12 wherein a stop member is disposed between said first and second members for limiting the angle of tilt therebetween.

19. The tilting mechanism as defined in claim 12 wherein said support is a chair support, said tiltable member is a chair seat, said first member encircles one end of said chair support, and further comprising an actuating member connected to and passing through a portion of said first member, said actuating member having one end located at the exterior of said first member and its opposite end located at the interior of said first member for interacting with said one end of chair support.

20. Apparatus positionable between a first member and a second member for allowing the members to be omnidirectionally tiltable relative to one another, so that the members may tilt forward and backward, side-to-side and all angles therebetween, comprising a first element securable to said first member, a second element securable to said second member, a pivot joint located between, and in contact with, said first and second elements about which said second member is tiltably movable relative to said first member, and resistance members connecting said first and second elements, located radially outwardly of said pivot joint, said resistance member fixedly connected at one end to one of said first or second elements and movably connected at its opposite end to the other of said first or second elements, so that said opposite end may rotate and move axially relative to said other of said first or second elements, thereby controlling the tilting movement said first and second elements, by being strained solely in a flexural mode in response to a force tending to tilt said first or second member about said pivot joint.

21. The apparatus as defined in claim 20 wherein said resistance members provide resistance to the tilting force and return said second member to a neutral, home position when the tilting force is removed.

22. Apparatus positionable between a support structure and a supported structure for allowing said structures to be omnidirectionally tiltable relative on one another, so that said structures may tilt forward and backward, side-to-side and all angles therebetween, comprising a first member securable to said support structure, a second member securable to said supported structure, a pivot joint disposed between, and in contact with, said support and supported structures about which said supported structure is tiltably movable relative to said support structure, and resistance elements connecting said first and second members, located radially outwardly of said pivot joint, said resistance element fixedly connected at one end to one of said first or second members and movably connected at its opposite end to the other of said first or second members, in a manner to allow said opposite end to rotate and to move axially relative to said other of said first or second members, thereby controlling the tilting movement between said support and supported structures, said restance elements being strained solely in a flexural mode as said support and supported structures move relative to one another, providing resistance to a force tending to tilt said second member about said pivot joint, and returning said second member to a neutral, home position when said force is removed.

* * * * *